US009495904B2

(12) United States Patent
Hsu et al.

(10) Patent No.: US 9,495,904 B2
(45) Date of Patent: Nov. 15, 2016

(54) LIGHT EMITTING DIODE MODULE

(71) Applicant: AU Optronics Corp., Hsin-Chu (TW)

(72) Inventors: Wei-Chu Hsu, Hsin-Chu (TW); Li-Wei Liu, Hsin-Chu (TW); Hua-Gang Chang, Hsin-Chu (TW)

(73) Assignee: AU OPTRONICS CORP., Hsin-Chu (TW)

( * ) Notice: Subject to any disclaimer, the term of this patent is extended or adjusted under 35 U.S.C. 154(b) by 315 days.

(21) Appl. No.: 13/969,628

(22) Filed: Aug. 19, 2013

(65) Prior Publication Data

US 2014/0339998 A1 Nov. 20, 2014

(30) Foreign Application Priority Data

May 14, 2013 (TW) ..... 102117050 A

(51) Int. Cl.
*H05B 33/08* (2006.01)
*G09G 3/32* (2016.01)

(52) U.S. Cl.
CPC ..... *G09G 3/3233* (2013.01); *H05B 33/0806* (2013.01); *G09G 2300/0814* (2013.01); *G09G 2300/0819* (2013.01)

(58) Field of Classification Search
CPC ..... H05B 33/0806; H05B 33/0896
USPC ..... 315/291; 345/211
See application file for complete search history.

(56) References Cited

U.S. PATENT DOCUMENTS 7,561,128 B2 7/2009 Ahn et al.
7,876,294 B2 1/2011 Sasaki et al.
2007/0085847 A1 4/2007 Shishido
2009/0174699 A1 7/2009 Fish et al.
2010/0225623 A1* 9/2010 Ohhashi ..... G09G 3/3233 345/205
2011/0096059 A1 4/2011 Ohhashi
(Continued)

FOREIGN PATENT DOCUMENTS

CN 101401145 A 4/2009
CN 102682704 A 9/2012
CN 102682705 A 9/2012

OTHER PUBLICATIONS

Tanabe et al. , New Threshold Voltage Compensation Pixel Circuits in 13.5-inch Quad Full High Definition OLED Display of Crystalline In-Ga-Zn-Oxide FETs, Jun. 2012 , pp. 88-91, vol. 43 Issue-1, society of information display, Boston.
(Continued)

*Primary Examiner* — Douglas W Owens
*Assistant Examiner* — Pedro C Fernandez
(74) *Attorney, Agent, or Firm* — McClure, Qualey & Rodack, LLP

(57) ABSTRACT

A light emitting diode module includes a light emitting unit and a light emitting diode circuit. The light emitting diode circuit includes four transistors and a storage capacitor. A first transistor includes a first end for receiving a data signal, and a control end. The storage capacitor has a first end coupled to a second end of the first transistor. A second transistor has a first end coupled to a first voltage source, and a control end. A third transistor has a first end coupled to a second end of the second transistor, and a control end coupled to a second end of the storage capacitor. A fourth transistor has a first end coupled to the second end of the storage capacitor, a control end, and a second end coupled to the second end of the second transistor.

10 Claims, 5 Drawing Sheets

(56) References Cited

U.S. PATENT DOCUMENTS

| | | | | |
|---|---|---|---|---|
| 2011/0169798 | A1* | 7/2011 | Lee | G09G 3/3233 345/211 |
| 2012/0154258 | A1 | 6/2012 | Asano | |

OTHER PUBLICATIONS

Kim et al., 40 Inch FHD AM-OLED Display with IR Drop Compensation Pixel Circuit, Jun. 2009 , pp. 85-87 , vol. 40 Issue-1 , Society of Information Display, Boston.

* cited by examiner

LIGHT EMITTING DIODE MODULE

BACKGROUND OF THE INVENTION

1. Field of the Invention

The present invention relates to a light emitting diode module, and more particularly, a light emitting diode module which can generate a stable operating current.

2. Description of the Prior Art

Due to their slim shapes, low power consumption and low radiation, liquid crystal displays (LCDs) are widely applied in electronic devices such as notebooks, monitors, and PDAs (personal digital assistants). Besides, the organic light emitting diode (OLED) display can be operated without a backlight source and color filters, and has a slimmer shape and better performance in color, thus the OLED display is also widely used.

However, in a pixel driving circuit of an OLED display of prior art, switch components used to control an operating current and the brightness of a light emitting diode are a source of instability. For example, the threshold voltage of a transistor is often biased after operating for along time, altering the current flowing through the light emitting diode and resulting in emitting an erroneous grey level. Besides, as the size of the display increases, the voltage drop from the voltage source deteriorates. This adds to the aging issue and worsens the instability of current flows and display quality.

Although there are some ways developed to compensate the threshold voltage bias, those methods lead to an increased number of switches and/or capacitors, lowering an aperture ratio of the display, and increasing the difficulty to design a driving circuit of a high resolution display.

SUMMARY OF THE INVENTION

An embodiment of the present invention discloses a light emitting diode module. The light emitting diode module comprises a light emitting unit and a light emitting diode circuit. The light emitting diode circuit is coupled to the light emitting unit and comprises a first transistor, a storage capacitor, a second transistor, a third transistor, and a fourth transistor. The first transistor comprises a first end configured to receive a data signal, a control end configured to receive a scan signal, and a second end. The storage capacitor comprises a first end coupled to the second end of the first transistor, and a second end. The second transistor comprises a first end coupled to a first voltage source, a control end configured to receive an enable signal, and a second end. The third transistor comprises a first end coupled to the second end of the second transistor, a control end coupled to the second end of the storage capacitor, and a second end. The fourth transistor comprises a first end coupled to the second end of the storage capacitor, a control end configured to receive a control signal, and a second end coupled to the second end of the second transistor.

Another embodiment of the present invention discloses a method for driving a light emitting diode module. The light emitting diode module comprises a light emitting unit and a light emitting diode circuit. The light emitting diode circuit is coupled to the light emitting unit and comprises a first transistor, a storage capacitor, a second transistor, a third transistor, and a fourth transistor. A first end of the first transistor is coupled to a data line. A second end of the first transistor is coupled to a first end of the storage capacitor. A second end of the storage capacitor is coupled to a control end of the third transistor and to a first end of the fourth transistor. A first end of the second transistor is coupled to a first voltage source. A second end of the second transistor is coupled to a first end of the third transistor and to a second end of the fourth transistor. The method comprises turning on the first transistor, the second transistor, and the fourth transistor so as to input a reference voltage from the data line to the storage capacitor, turning off the second transistor after inputting the reference voltage from the data line to the storage capacitor, turning off the fourth transistor after turning off the second transistor, inputting a data voltage from the data line to the storage capacitor, turning off the first transistor when inputting the data voltage from the data line to the storage capacitor, and turning on the second transistor after turning off the first transistor.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
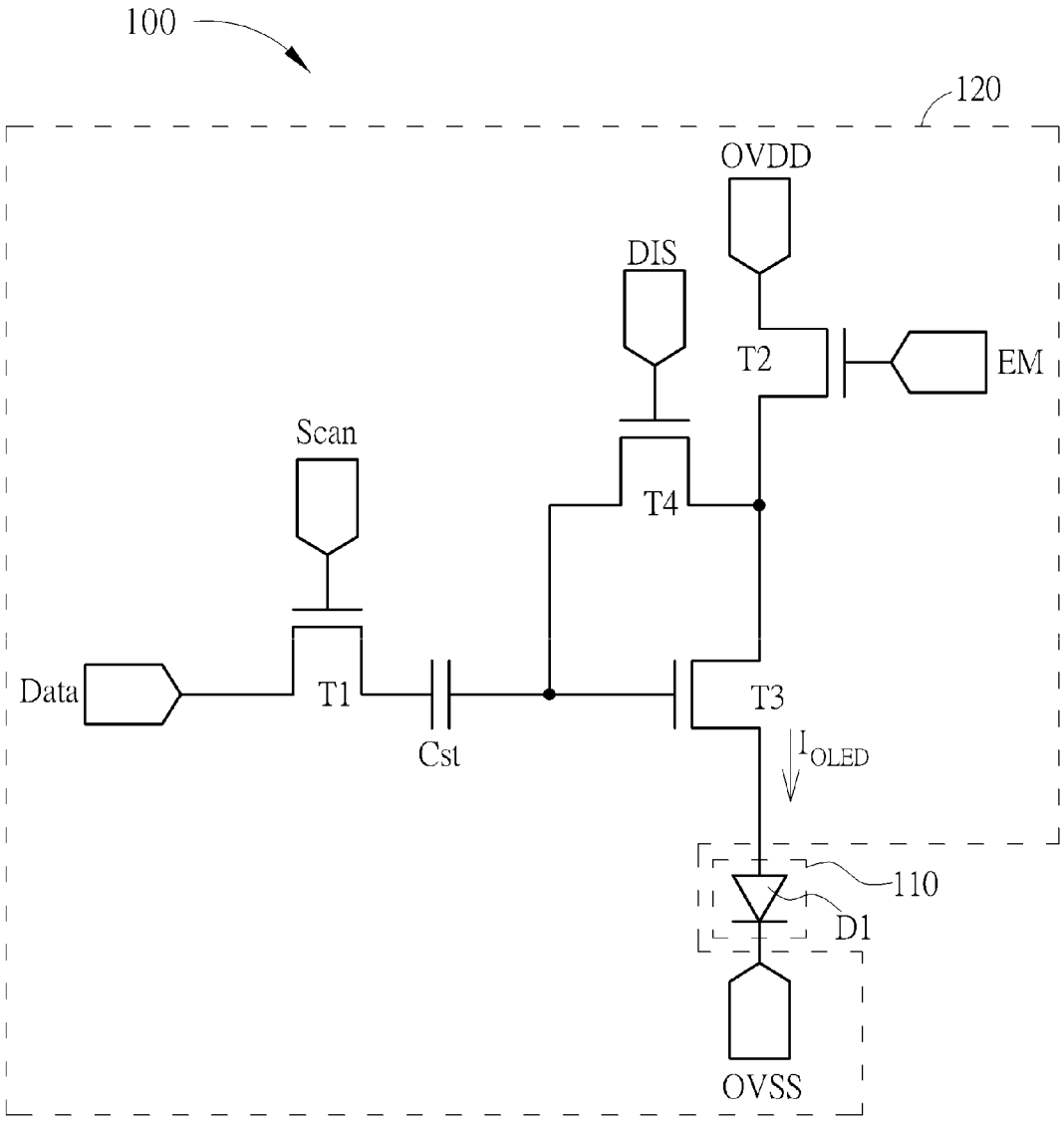
FIG. 1 shows a light emitting diode module according to a first embodiment of the present invention.

The detailed descriptions of the present invention are exemplified below in examples. However, the examples are merely used to illustrate the present invention, not to limit the present invention. Because one skilled in the art may modify the present invention or combine the present invention with some features within the scope of the present invention, the claimed scope of the present invention should be referred to in the following claims.

In the entire specification and claims, unless the contents clearly specify the meaning of some terms, the terms "a" or "the" may refer to one or at least one of elements or components. Besides, in the present disclosure, unless it can be clearly seen from the relating context that the examples or embodiments do not refer to multiple elements or components, singular articles may refer to one or at least one of elements or components. The meanings of every term used in the present claims and specification refer to a usual meaning known to one skilled in the art unless the meaning is additionally annotated. Some terms used to describe the present invention will be discussed to guide practitioners about the present invention. Every example in the present specification cannot limit the claimed scope of the present invention.

The terms "substantially," "around," "about" and "approximately" can refer to within 20% of a given value or range, and preferably within 10%. Besides, the quantities provided herein can be approximate ones and can be described with the aforementioned terms if are without being specified. When a quantity, density, or other parameters includes a specified range, preferable range or listed ideal values, their values can be viewed as any number within the given range. For example, if it is described that the length of a component is X cm to Y cm, then it is equivalent to sentence "the length of the component is H, and H can be any real number value between the values of X and Y."

Further, in the present specification and claims, the term "comprising" is open type and should not be viewed as the term "consisted of." Besides, the term "electrically coupled" can be referring to either directly connecting or indirectly connecting between elements. Thus, if it is described in the below contents of the present invention that a first device is electrically coupled to a second device, the first device can be directly connected to the second device, or indirectly connected to the second device through other devices or means. Moreover, when the transmissions or generations of electrical signals are mentioned, one skilled in the art should understand some degradations or undesirable transformations could be generated during the operations. If it is not specified in the specification, an electrical signal at the transmitting end should be viewed as substantially the same signal as that at the receiving end. For example, when the end A of an electrical circuit provides an electrical signal S to the end B of the electrical circuit, the voltage of the electrical signal S may drop due to passing through the source and drain of a transistor or due to some parasitic capacitance. However, the transistor is not deliberately used to generate the effect of degrading the signal to achieve some result, that is, the signal S at the end A should be viewed as substantially the same as that at the end B.

Furthermore, it can be understood that the terms "comprising," "including," "having," "containing," and "involving" are open-ended terms, which refer to "may include but is not limited to so." Besides, each of the embodiments or claims of the present invention is not necessary to achieve all the effects and advantages possibly to be generated, and the abstract and title of the present invention is used to assist for patent search and is not used to further limit the claimed scope of the present invention.

The embodiments and figures are provided as follows in order to illustrate the present invention in detail, but the claimed scope of the present invention is not limited by the provided embodiments and figures.

Please refer to FIG. 1 which shows a light emitting diode module 100 according to a first embodiment of the present invention. As FIG. 1 shows, the light emitting diode module 100 comprises a light emitting unit 110 and a light emitting diode circuit 120. The light emitting unit 110 comprises a light emitting diode D1. The light emitting diode circuit 120 comprises a first transistor T1, a storage capacitor Cst, a second transistor T2, a third transistor T3, and a fourth transistor T4. The first transistor T1 has a first end configured to receive a data signal Data, a control end configured to receive a scan signal Scan, and a second end. The storage capacitor Cst has a first end coupled to the second end of the first transistor T1 and a second end. The second transistor T2 has a first end coupled to a first voltage source OVDD, a control end configured to receive an enable signal EM, and a second end. The third transistor T3 has a first end coupled to the second end of the second transistor T2, a control end coupled to the second end of the storage capacitor Cst, and a second end. The fourth transistor T4 has a first end coupled to the second end of the storage capacitor Cst, a control end configured to receive a control signal DIS, and a second end coupled to the second end of the second transistor T2. The light emitting diode D1 has a first end coupled to the second end of the third transistor T3, and a second end coupled to a second voltage source OVSS. The first end of the light emitting diode D1 can be an anode, and the second end of the light emitting diode D1 can be a cathode.

In the present invention, the first transistor T1, the second transistor T2, the third transistor T3, and the fourth transistor T4 can be N-type thin film transistors (TFTs). They can also be replaced with P-type TFTs. Besides, the first voltage source OVDD is a high voltage source, and the second voltage source OVSS is a low voltage source.

Figure 2:
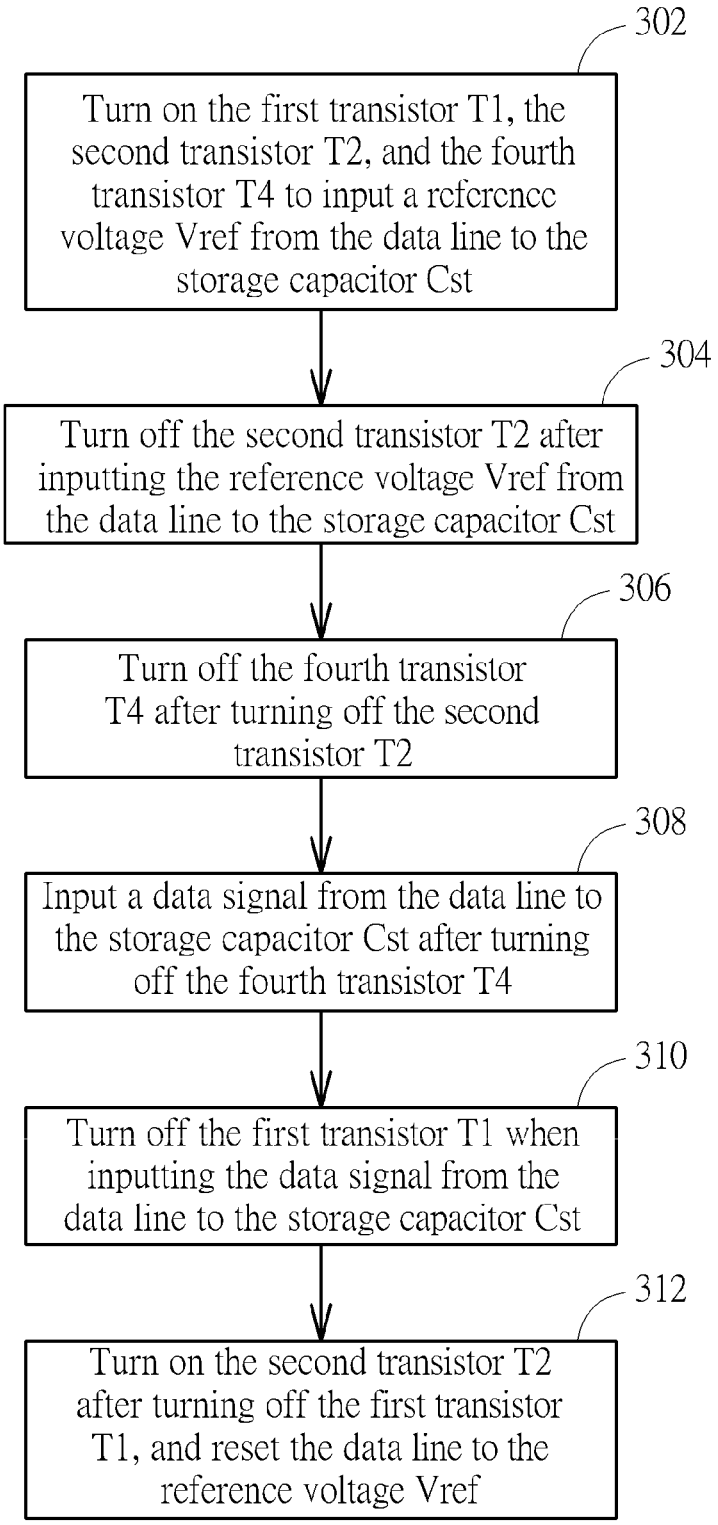
FIG. 2 is a flowchart for driving the light emitting diode module in FIG. 1.
Figure 3A:
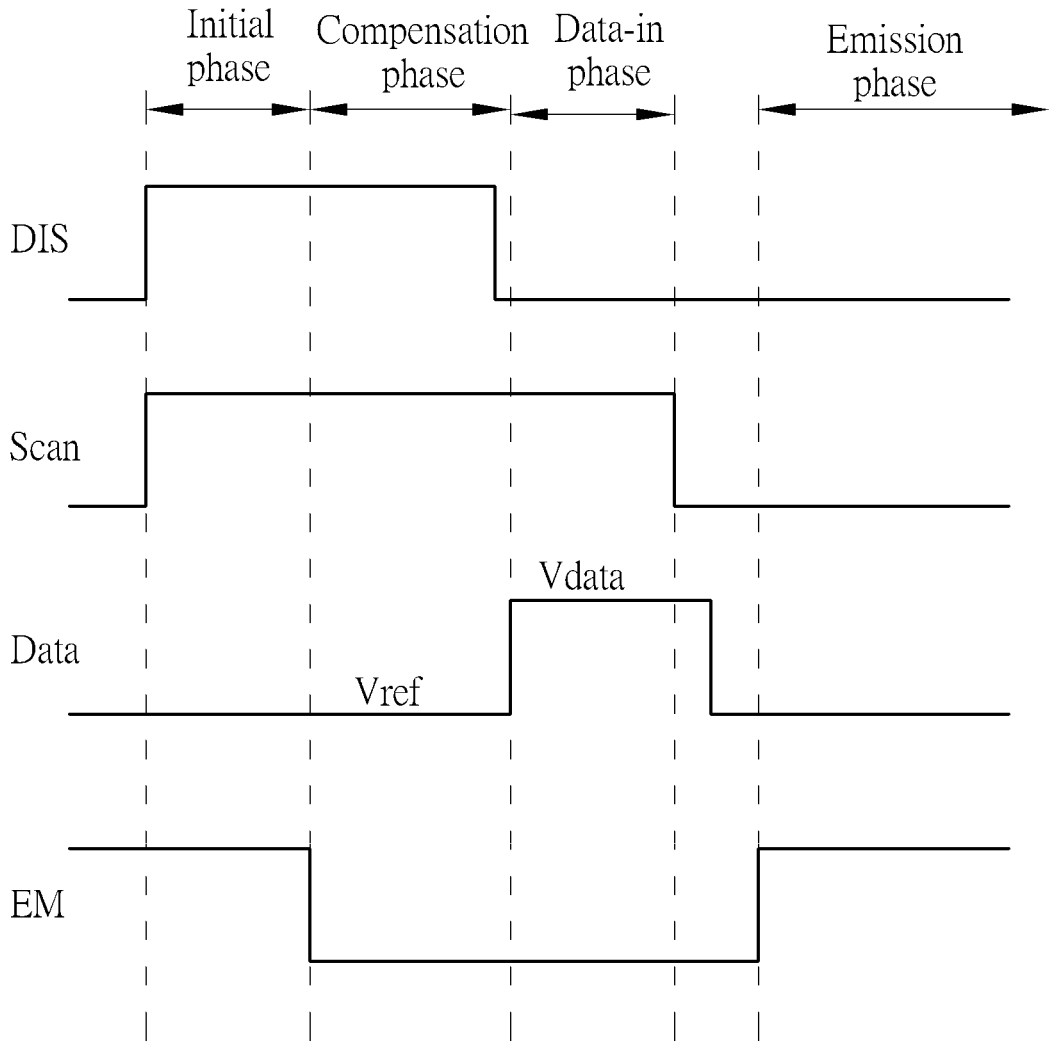
FIG. 3A is a timing diagram for driving the light emitting diode module in FIG. 1.

Please refer to FIG. 2 and FIG. 3A. FIG. 2 is a flowchart for driving the light emitting diode module 100. FIG. 3A is a timing diagram for driving the light emitting diode module 100. The flowchart for driving the light emitting diode module 100 is as follows:

Step 302: turn on the first transistor T1, the second transistor T2, and the fourth transistor T4 to input a reference voltage Vref from the data line to the storage capacitor Cst;

Step 304: turn off the second transistor T2 after inputting the reference voltage Vref from the data line to the storage capacitor Cst;

Step 306: turn off the fourth transistor T4 after turning off the second transistor T2;

Step 308: input a data signal from the data line to the storage capacitor Cst after turning off the fourth transistor T4;

Step 310: turn off the first transistor T1 when inputting the data signal from the data line to the storage capacitor Cst;

Step 312: turn on the second transistor T2 after turning off the first transistor T1, and reset the data line to the reference voltage Vref.

In the FIG. 3A, the control signal DIS, the scan signal Scan, the data signal Data, and the enable signal EM are arranged from top to bottom. The timing diagram in FIG. 3A includes four phases in sequence: Initial phase, Compensation phase, Data-in phase, and Emission phase. In the step 302, the first transistor T1, the second transistor T2, and the fourth transistor T4 are turned on in the Initial phase to input the reference voltage Vref from the data line to the storage capacitor Cst. After the first transistor T1, the second transistor T2, and the fourth transistor T4 are turned on, the third transistor T3 is then turned on accordingly.

In the Initial phase, because the first transistor T1, the second transistor T2, and the fourth transistor T4 are turned on, the first end and the control end of the third transistor T3 are substantially at the voltage of the first voltage source OVDD, and the voltage of the first end of the storage capacitor Cst is substantially the same as the reference voltage Vref. Because the third transistor T3 is operated as a diode at this time, the second end of the third transistor T3 is substantially at a voltage equal to the sum of the voltage of the second voltage source OVSS and the cross voltage $V_{OLED}$ of the diode D1, that is, $V_{OLED}$+OVSS. In the following Compensation phase, the second transistor T2 is turned off because the enable signal EM changes to a low level, but the first transistor T1 and the fourth transistor T4 are still turned on so as to keep the first end of the storage capacitor Cst at the level of Vref. The first end and the control end of the third transistor T3 are both substantially at the level of $V_{TH3}$+$V_{OLED}$+OVSS. $V_{TH3}$ is the threshold voltage of the third transistor T3. At this time, the third transistor T3 is also operated as a diode, and the second end of the third transistor T3 is still kept at the voltage $V_{OLED}$+OVSS. Then, the control signal DIS is pulled down to a low level before the Data-in phase so as to turn off the fourth transistor T4, and the first end of the third transistor T3 is thus floating. Because the control end of the third transistor T3 is substantially at the voltage of $V_{TH3}$+$V_{OLED}$+OVSS, the third transistor T3 is still turned on, and the second end of the third transistor T3 is also floating just like the first end of the third transistor T3.

In the Data-in phase, the level of the data signal is pulled up from Vref to a data level Vdata. At this time, the control end of the third transistor T3 is substantially at the voltage of $V_{TH3}+V_{OLED}$+OVSS+Vdata−Vref, and this keeps the third transistor T3 turned on so that the first end and the second end of the third transistor T3 are still substantially floating. At the end of the Data-in phase, the scan signal Scan is pulled down to a low level so as to turn off the first transistor T1, and then the level of the data signal Data is reduced from Vdata to Vref. However, the first transistor T1 is turned off already, thus the first end of the storage capacitor Cst is substantially kept at Vdata. After entering the Emission phase, because the first transistor T1 is still turned off, the first end of the storage capacitor Cst is substantially kept at Vdata, and the control end of the third transistor T3 is substantially kept at the level of $V_{TH3}+V_{OLED}$+OVSS+Vdata−Vref. Besides, because the enable signal EM changes to the high level, the first end of the third transistor T3 is substantially at the level of the first voltage source OVDD. Moreover, because the third transistor T3 is operated at the saturation region, the second end of the third transistor T3 is substantially at the voltage of $V_{OLED}$+OVSS. The current flowing through the light emitting diode D1 can be derived with a formula (1):

$$I_{OLED}=k(V_{GS3}-V_{TH3})^2=k(V_{G3}-V_{S3}-V_{TH3})^2 \quad (1)$$

In formula (1), $I_{OLED}$ stands for a current flowing through the light emitting diode D1, k is a constant, $V_{GS3}$ stands for a voltage difference from the control end (gate terminal) to the second end (source terminal) of the third transistor T3, and $V_{S3}$ stands for the voltage of the second end (source terminal) of the third transistor T3. Hence, according to the configuration of the first embodiment, the voltage at the control end of the third transistor T3 in the Emission phase, $V_{TH3}+V_{OLED}$+OVSS+Vdata−Vref, can substitute $V_{G3}$, and also $V_{OLED}$+OVSS can substitute $V_{S3}$. A formula (2) is thus derived:

$$I_{OLED}=k(V\text{data}-V\text{ref})^2 \quad (2)$$

According to the formula (2), the current $I_{OLED}$ flowing through the light emitting diode D1 is only determined by Vdata and Vref. Because Vdata and Vref are not related to the threshold voltage $V_{TH3}$ of the third transistor T3, the first voltage source OVDD, or the cross voltage $V_{OLED}$ of the light emitting diode D1, the current used to drive the light emitting diode D1 is thus not influenced by the bias of the threshold voltage $V_{TH3}$ of the third transistor T3, the voltage drop of the first voltage source OVDD, and/or the aging of the OLED of the light emitting diode D1.

Figure 3B:
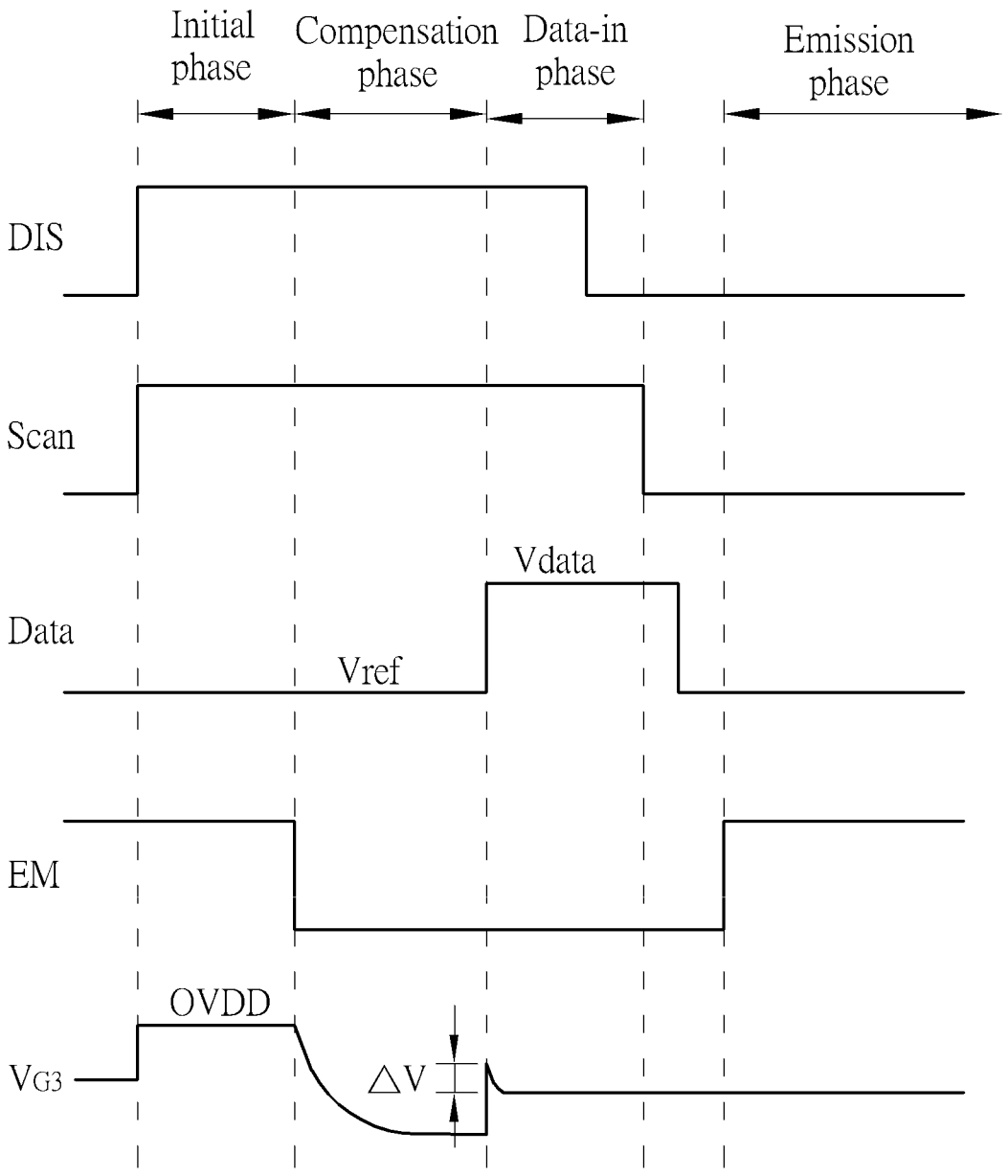
FIG. 3B is another timing diagram for driving the light emitting diode module in FIG. 1.

Please refer to FIG. 3B which shows another timing diagram for driving the light emitting diode module 100. The difference from FIG. 3A to FIG. 3B is that: in FIG. 3B, the control signal DIS is pulled down to a low level to turnoff the fourth transistor T4 after entering the Data-in phase, and the voltage level of $V_{G3}$ is pulled up first when entering the Data-in phase from the Compensation phase and then is gradually discharged in the Data-in phase so that the control end of the third transistor T3 is substantially at the voltage level of $V_{TH3}+V_{OLED}$+OVSS+Vdata−ΔV where ΔV is a voltage difference. Though electron mobility is not consistent for different transistors and electron mobility varies with ΔV, the problem caused by inconsistent electron mobility of third transistors T3 of different light emitting diode circuits 120 can be solved because the current $I_{OLED}$ flowing through the light emitting diode D1 is not dependent on the mobility of the third transistor T3.

Figure 4:
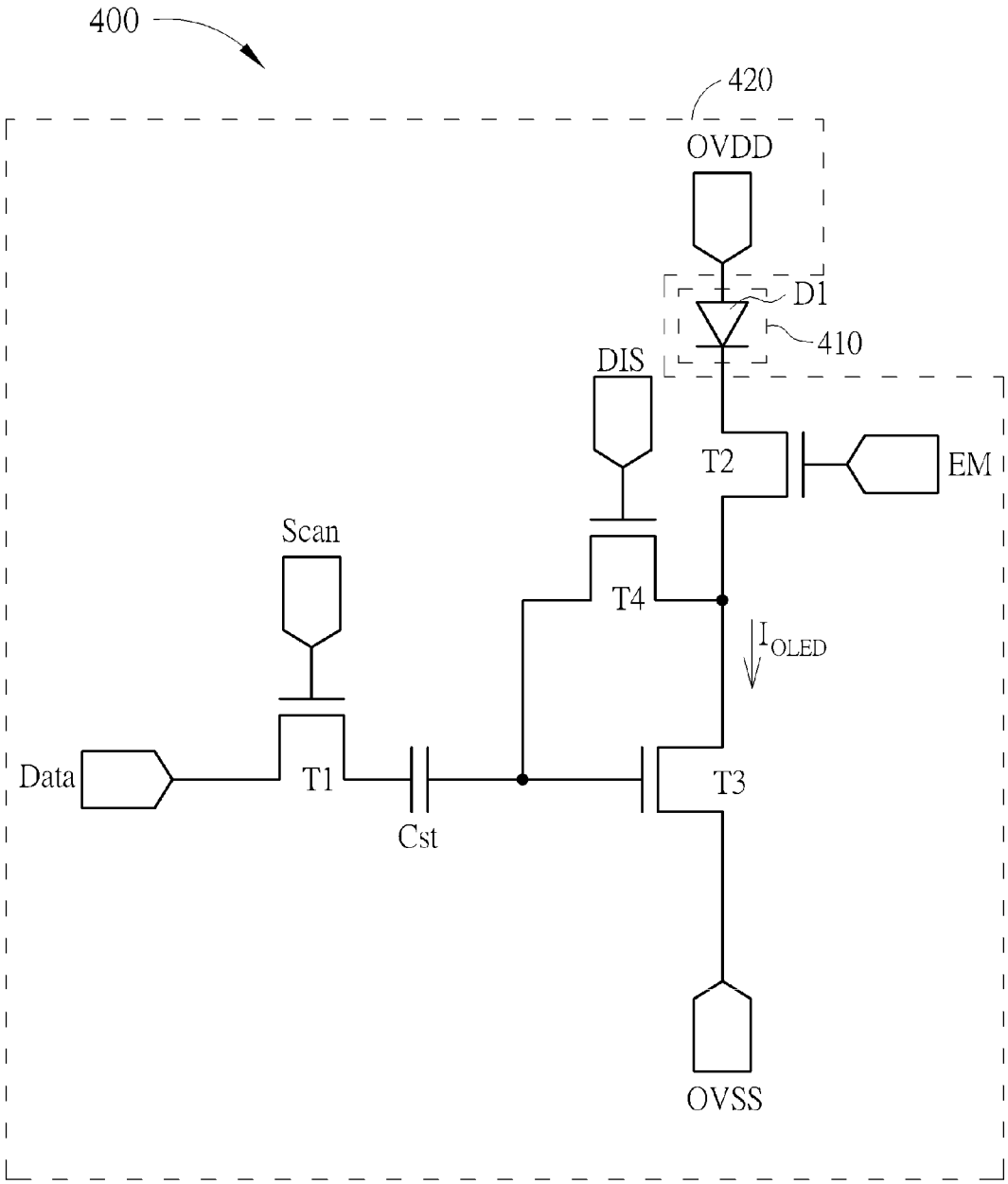
FIG. 4 shows a light emitting diode module according to a second embodiment of the present invention.

Please refer to FIG. 4 which shows a second embodiment of the light emitting diode module 400 of the present invention. As shown in FIG. 4, the light emitting diode module 400 comprises a light emitting unit 410 and a light emitting circuit 420. The light emitting unit 410 comprises a light emitting diode D1. The difference between the light emitting diode modules 400 and 100 is the position of the light emitting diode D1. In the light emitting diode module 400, the light emitting diode D1 has a first end coupled to the first voltage source OVDD, and a second end. The second transistor T2 has a first end coupled to the second end of the light emitting diode D1, a control end configured to receive an enable signal EM, and a second end. The third transistor T3 has a first end coupled to the second end of the second transistor T2, a control end coupled to a second end of a storage capacitor Cst, and a second end coupled to a second voltage source OVSS.

Similarly, in the second embodiment, the current for driving the light emitting diode D1 of the light emitting diode module 400 is not affected by the bias of the threshold voltage $V_{TH3}$ of the third transistor T3, the voltage drop of the first voltage source OVDD, and/or the aging of the OLED of the light emitting diode D1. Moreover, the steps of operation and timing sequence of operating the light emitting diode module 400 can be referred to FIG. 2 and FIG. 3A and are thus not repeated herein.

In conclusion, through the first and the second embodiments of the present invention, the current for driving the light emitting diode D1 of the light emitting diode modules 100 and 400 can be kept stable without reducing the aperture ratio because the current is not affected by the bias of the threshold voltage of the third transistor T3, the voltage drop of the first voltage source OVDD, and/or the aging of the OLED of the light emitting diode D1.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A light emitting diode module comprising:

a light emitting unit; and a light emitting diode circuit connected to the light emitting unit, the light emitting diode circuit consisting of:

a first transistor having a first end configured to receive a data signal, a control end configured to receive a scan signal, and a second end;

a storage capacitor having a first end connected to the second end of the first transistor and a second end;

a second transistor having a first end connected to a first voltage source, a control end configured to receive an enable signal, and a second end;

a third transistor having a first end connected to the second end of the second transistor, a control end connected to the second end of the storage capacitor, and a second end; and a fourth transistor having a first end connected to the second end of the storage capacitor, a control end configured to receive a control signal, and a second end connected to the second end of the second transistor.

2. The light emitting diode module of claim 1 wherein the light emitting unit has a first end connected to the second end of the third transistor and a second end connected to a second voltage source.

3. The light emitting diode module of claim 1 wherein the light emitting unit has a first end connected to the first voltage source and has a second end connected to the first end of the second transistor.

4. The light emitting diode module of claim 1 wherein the first transistor, the second transistor, the third transistor, and the fourth transistor are N-type thin film transistors.

5. A method for driving a light emitting diode module, the light emitting diode module comprising a light emitting unit and a light emitting diode circuit connected to the light emitting unit, the light emitting diode circuit consisting of a first transistor, a second transistor, a third transistor, a fourth transistor, and a storage capacitor, a first end of the first transistor being connected to a data line, a second end of the first transistor being connected to a first end of the storage capacitor, a second end of the storage capacitor being connected to a connected end of the third transistor and a first end of the fourth transistor, a first end of the second transistor being coupled to a first voltage source, and a second end of the second transistor being connected to a first end of the third transistor and a second end of the fourth transistor, the method comprising:

turning on the first transistor, the second transistor, and the fourth transistor conductive so as to input a reference voltage from the data line to the storage capacitor;

turning off the second transistor after inputting the reference voltage from the data line to the storage capacitor;

turning off the fourth transistor after turning off the second transistor; inputting a data voltage from the data line to the storage capacitor;

turning off the first transistor when inputting the data voltage from the data line to the storage capacitor; and turning on the second transistor after turning off the first transistor.

6. The method of claim 5 wherein inputting the data voltage from the data line to the storage capacitor is performed after turning off the fourth transistor.

7. The method of claim 5 wherein the light emitting unit has a first end connected to a second end of the third transistor and a second end connected to a second voltage source.

8. The method of claim 5 wherein the light emitting unit has a first end connected to the first voltage source and a second end connected to the first end of the second transistor.

9. The method of claim 5 further comprising resetting the data line to the reference voltage after turning off the first transistor.

10. The method of claim 5 wherein the first transistor, the second transistor, the third transistor, and the fourth transistor are N-type thin film transistors.

* * * * *